US005444995A

United States Patent [19]

Benetton

[11] Patent Number: 5,444,995

[45] Date of Patent: Aug. 29, 1995

[54] PROCESS FOR MANUFACTURING A COMPLETE GARMENT ON A TWO NEEDLE BED FLAT KNITTING MACHINE

[75] Inventor: Giuliana Benetton, Treviso, Italy

[73] Assignee: Benetton Group S.P.A., Ponzano-Veneto, Italy

[21] Appl. No.: 205,715

[22] Filed: Mar. 4, 1994

[30] Foreign Application Priority Data

Mar. 5, 1993 [IT] Italy ..... MI93A0423

[51] Int. Cl.[6] ..... D04B 1/24

[52] U.S. Cl. ..... 66/64; 66/176

[58] Field of Search ..... 66/64, 175, 176

[56] References Cited

U.S. PATENT DOCUMENTS 3,474,643 10/1969 Robinson et al. ..... 66/176 X
3,668,901 6/1972 Betts et al. ..... 66/176
3,685,316 8/1972 Robinson et al. ..... 66/64
3,702,068 11/1972 Betts et al. ..... 66/176
4,095,441 6/1978 Robinson et al. ..... 66/176
4,197,724 4/1980 Robinson et al. ..... 66/176
5,214,941 6/1993 Essig ..... 66/175
5,275,022 1/1994 Stoll et al. ..... 66/64 X

*Primary Examiner*—John J. Calvert
*Attorney, Agent, or Firm*—Herbert Dubno

[57] ABSTRACT

The process for manufacturing a complete garment on a two needle bed flat knitting machine, which operates with latch needles, which process consist of the fact that at least at the beginning of the manufacture of the garment, half of the needles of the front needle bed are put to work with the empty (idle) needles of the rear needle bed and viceversa in order to perform, during the steps of forming of the tubular portions of said garment, also an operation of narrowing of the knitted product in pre-established areas of said tubular portions.

4 Claims, 2 Drawing Sheets

PROCESS FOR MANUFACTURING A COMPLETE GARMENT ON A TWO NEEDLE BED FLAT KNITTING MACHINE

FIELD OF THE INVENTION

The present invention relates to a process for making a complete garment on a (straight bar) flat knitting machine having two needle beds and latch needles.

BACKGROUND OF THE INVENTION

It is well known in the art that the two needle bed machines having a front and a rear needle bed and latch needles are normally capable of fashioning different parts of a garment which will be thereafter linked among each other by a sewing operation.

Accordingly the manufacture for instance of a pullover consists of forming on a knitting machine of this kind the different parts which form the pullover (front part, rear part, sleeves, etc.). At a second point in time, the different parts are linked by means of a looping operation.

The above way of proceeding implies, as is easy to understand, the performance of an additional operation, which is carried out in an independent step from the operation which is performed by the flat knitting machine, after the different parts of the garments have been manufactured on the same.

This fact brings about an increase of the costs of manufacturing of the garment due both to the increased time which is needed in order to fulfill it and to further intervention of specialized manpower.

OBJECTS OF THE INVENTION

It is the object of the present invention to eliminate the above-mentioned inconveniences, by devising a drawbacks and to provide an improved process for the manufacture of a complete garment on a two-needle-beds, knitting machines using latch needles, which eliminates the seperate operation of sewing or of the looping of the different parts which form the garment.

Another object of the invention is to provide a process which permits production of a complete garment with better aesthetical appearance with respect to the conventional garments since it does not show any sewing of the different parts which make the garment itself.

Yet a further object of the invention is to provide a process for manufacturing a complete garment which implies a very restricted cost which is surely lower than the cost of the garments manufactured with conventional methods.

SUMMARY OF THE INVENTION

The above solution and the above objects are attained by a process for manufacturing a complete garment on a two needle bed knitting machine using latch needles. According to the Invention at least at the beginning of the manufacture of the garment, half of the needles of the front needle bed are put to work with the empty (idle) needles of the rear needle bed and vice versa in order to perform, during the steps of forming of the tubular portions of said garment, also an operation of narrowing of the knitted product in pre-established areas of said tubular portions.

The garment which is obtained by the above process is an aspect of the present invention as well and is characterized in that it is free from any sewing between the different component parts.

BRIEF DESCRIPTION OF THE DRAWING

Further features and advantages of the invention will become more readily apparent from the following description of a preferred but nonexclusive embodiment of the process for manufacturing a complete garment on a two needle bed. knitting machine using latch needles, according to the invention, which is illustrated diagrammatically in the accompanying drawings in which.

SPECIFIC DESCRIPTION

The process for the manufacture of a complete garment on a latch-needle two-needle bed flat knitting machine according to the invention, consists of putting to work, at least in an initial step of the manufacture of the garment, half of the needles of the front needle bed with half of the empty (idle) needles of the rear needle bed, and further consists of putting to work, vice versa, half of the needles of the rear needle bed with half of the empty (idle) needles of the front needle bed.

In the operation-sequence drawing (FIGS. 6–12), the underlined numbers and letters mean that the corresponding needles are working.

As a general proposition and as is well known, in a knitting machine with latch needles, the front and rear needle beds are movable towards the left or right side.

As will be apparent from the description below, only the rear needle bed is displaced in a first step towards the right side and in a second step towards the left side.

Figure 3:
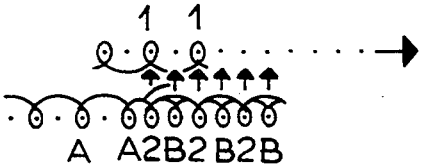
Figure 4:
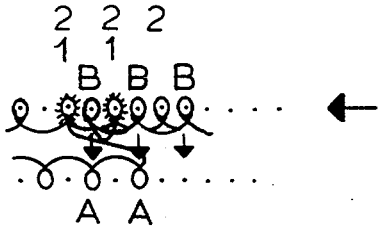

More precisely, as can be seen from FIGS. 3 and 4, the rear needle bed has been displaced firstly towards the right hand side (FIG. 3) in order that the needles 1 are aligned with the needles 2 and secondly towards the left hand side (FIG. 4) in order that the needles B are aligned with the needles A.

Figure 1:
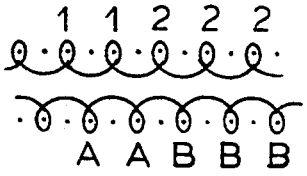
FIGS. 1, 2, 2*a*, 3, 3*a*, 4 and 5 diagrammatically show the movement of the needles on the two needle-beds flat knitting machine in successive operations for performing for instance the narrowing which is necessary for the shoulder of the pullover according to the process of the present invention.
Figure 5:
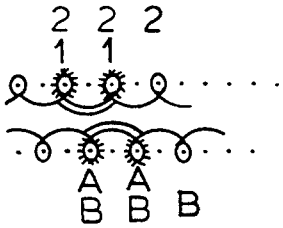
Figure 6:
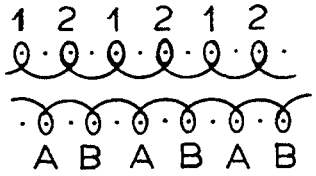
FIGS. 6, 7, 8, 9, 10, 11 and 12 diagrammatically show the movement of the needles in order to produce 1:1, ribbing of knitwear according to the present invention.

After that the needles B are displaced to the front needle bed (FIG. 5). It can be appreciated that for each needle there are two loops indicated with 1, 2 and A, B while the needles are displaced as in the initial position, i.e. as in FIG. 1.

Figure 2:
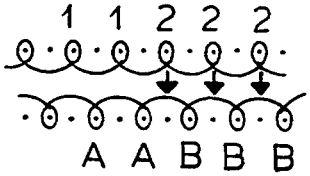
Figure 2A:
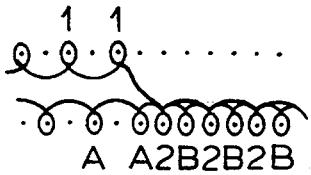
Figure 3A:
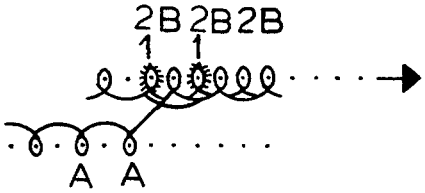

FIGS. 2*a* and 3*a* represent the position of the needles before their displacement according to FIGS. 3 and 4, respectively.

When in the specification it is said that "a needle is transferred" e.g. from the rear needle bed to the front rear needle bed and vice versa, of course, it will be understood that it is the loop on the needle which is actually passed.

It is thus possible to perform on the two needle bed flat knitting machine the manufacture of the tubular portions, such as for instance the sleeves and the body of the garment, which for instance may be a pullover, a sleeve, a stocking, etc. When needed, in a pre-established area of the tubular portions a narrowing of the knitted product can also be carried out.

It is in this way possible to produce a complete garment which is finished in all its portions directly on the two bed flat knitting machine.

According to the invention, the garment is formed by simultaneously manufacturing of its tubular portions and the performance of the narrowing of the knitted product; a pullover with a rib knitting can be produced with a plain stitch and a back stitch, along the border both of the body and of the sleeves as well as the border of the neck.

With reference to the FIGS. 1 to 5, in which as an example the operational positions of the needles are diagramatically shown in order to perform the narrowing of the right hand shoulder of a pullover, reference is more specifically made for example to a module of needles of the needle beds which are representative of the movements of all the needles of the needle beds.

In FIGS. 4 and 5 the needles 1.2 and A, B are jointly shown because each needle has two loops.

Initially the needles on the first and the second needle bed are preset in such a way that one needle knits and the second one is left idle; and each operational needle of the front needle bed corresponds to an idle needle on the rear needle bed, and vice versa.

Assuming that the operational needles of the rear needle bed, which for instance are capable of manufacturing the sleeve of a pullover, are here indicated with the reference numerals 1 and 2, and that the needles of the front needle bed which are capable of manufacturing the same sleeve of the pullover, are indicated with reference letters "A" and "B". Provision is made to transfer, in an initial step, the loop from the needles 2 of the rear needle bed is sat between the needles "A" and "B" of the front needle bed.

Thereafter, after the rear needle bed has been displaced toward the right-hand side, for example, by an amount corresponding to four needles, the loops on needles 2 and "B" of the front needle bed are transferred on the back needle bed.

Thereafter, after having displaced the rear needle bed towards the left hand side of a quantity corresponding to four needles, the needles "B" of the rear needle bed are displaced towards the front needle bed so as to obtain the same number of needles on the front and the rear needle bed (among the operational and the idle-needles) as were present in the initial position. While the loop is displaced towards the left hand side, if the narrowing of the right hand area of the pullover is performed, such displacement occurs in connection with a pre-established number of needles, for instance four if the narrowing is substantially of 45°.

It is clear that in order to perform the narrowing of the left hand area it is enough to carry out the same operational steps which have been described herebefore, by transferring the loops on needles 2 and "B" in the right hand direction.

If on the garment made as herebefore described also a rib stitch knitting has to be performed, for instance in order to have some tracks appearing or for forming the sleeves and the body of the garment, the displacement of the loops upon the needles is performed as shown in FIGS. 6–12 Of the drawings.

Numbering with 1 and 2 the needles which are present on the front needle bed and with the letters "A" and "B" the needles which are present on the front needle bed, the needle are arranged so as to form a 1:1 rib knitting over the whole knitwear.

The loop on needle "B" is transferred on the rear needle bed so as to be able to perform the feeding of yarn to needle "B" on the rear needle bed and to needle "A" on the front needle bed.

Thereafter on the front needle bed the loops on needles 2 and "B" are transferred so as to be able to work on the rear needle bed with the needle 1 and to work on the front needle bed with needle 2.

At this point on the rear needle bed the loops on needles 2 and "B" are transferred so as to obtain the initial position in order to perform the feeding of yarn, during which the needle "B" is put to work on the rear needle bed and the needle "A" is put to work on the front needle bed.

It is clear that in order to perform a rib knitting which instead of 1:1 has a 5:2 ratio, the movements of the loops on the needles remain the same but only their number is modified.

The garment manufacture according to the above described steps is free from any sewing between the different parts which compose the garment itself.

Figure 7:
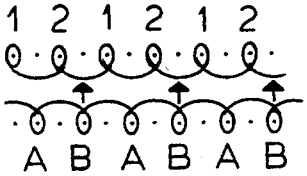
Figure 8:
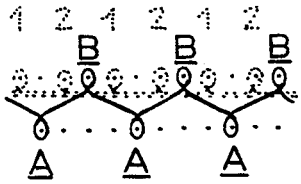
Figure 9:
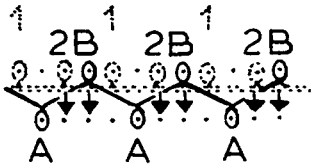
Figure 10:
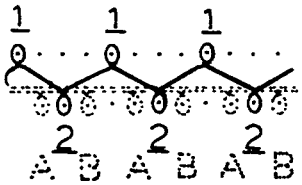
Figure 11:
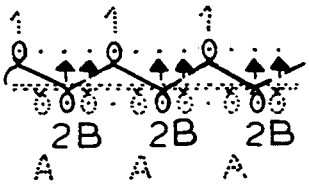
Figure 12:
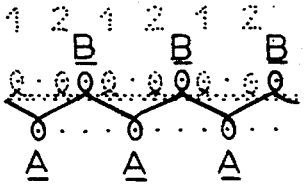

In FIG. 7 B is being transferred, in FIG. 8 the needles A and B are working, in FIG. 9 the needles 2 and B are being transferred, in FIG. 10 the needles 1 and 2 are working, in FIG. 11 the needles 2 and B are being transferred and in FIG. 12 the needles A and B are working.

For example in the case of a garment which is a pullover, there are no lateral sewings or looping of the body and of the sleeves which have to be performed after the manufacture of the pullover itself in the conventional way.

The so conceived invention is susceptible of several modifications and variations which all fall within the scope of the inventive concept; furthermore, all the details can be replaced by technically equivalent elements.

Practically any material can be used and any dimensions, according to the requirements and to the state of the art.

I claim:

1. A process for making a tubular knit article comprising the steps of:

(a) providing on a two-needle-bed latch needle knitting machine a front needle bed having a multiplicity of front latch needles with a given spacing and a rear needle bed with a corresponding number of rear latch needles with the same spacing;

(b) looping a yarn onto alternate ones of said front latch needles to form front working needles with loops thereon alternating with front idle needles, and looping said yarn onto alternate ones of said rear latch needles located between the front working needles to form rear working needles alternating with rear idle needles and aligned with said front idle needles;

(c) knitting a seamless tubular portion of said article using only said working needles; and (d) knitting a narrowed portion of said article directly on and as a continuation of said tubular portion by (d1) transferring loops from some of said rear working needles to certain front idle needles aligned therewith, (d2) shifting said rear bed by a distance corresponding to the spacing of a plurality of needles relative to said front bed in one direction to align rear working needles with loops thereon with said certain front idle needles (d3) transferring loops from said certain front idle needles to said rear working needles having non-transferred loops thereon and loops from some of the front working needles to certain of said idle needles of the rear bed (d4) shifting said rear bed in a direction opposite said one direction to align said certain of said idle needles of the rear bed with loop-retaining working needles of the front bed, and (d5) transferring loops from said certain of said idle needles of the rear bed to said loop-retaining working needles of the front bed.

2. The process defined in claim 1 wherein the number of working needles of said front bed is the same as the number of working needles of said rear bed.

3. The process defined in claim 1 wherein at least part of said tubular portion is knitted by a rib knitting by:

(e1) transferring a loop from one of two successive front working needles to an opposite idle needle of said rear bed, (e2) transferring loops on said opposite idle needle and an adjacent rear working needle to respective opposite needles of said front bed, and (e3) then transferring said loops from said opposite needles of said front bed to corresponding needles of said rear bed in successive workings of needles of said front and rear beds.

4. A process for making a tubular knit article comprising the steps of:

(a) providing on a two-needle-bed latch needle knitting machine a front needle bed having a multiplicity of front latch needles with a given spacing and a rear needle bed with a corresponding number of rear latch needles with the same spacing;

(b) looping a yarn onto alternate ones of said front latch needles to form front working needles with loops thereon alternating with front idle needles, and looping said yarn onto alternate ones of said rear latch needles located between the front working needles to form rear working needles alternating with rear idle needles and aligned with said front idle needles;

(c) knitting a seamless tubular portion of said article using only said working needles; and (d) forming a rib pattern on said tubular portion by successively:

(d1) transferring a loop from one of two successive front working needles to an opposite idle needle of said rear bed, (d2) transferring loops on said opposite idle needle and an adjacent rear working needle to respective opposite needles of said front bed, and (d3) then transferring said loops from said opposite needles of said front bed to corresponding needles of said rear bed in successive workings of needles of said front and rear beds.

* * * * *